US006196803B1

(12) United States Patent
Hill et al.

(10) Patent No.: US 6,196,803 B1
(45) Date of Patent: Mar. 6, 2001

(54) AIR CIRCULATOR FAN

(75) Inventors: D. Lee Hill, Olean, NY (US); Edward N. Koop, Olathe, KS (US)

(73) Assignee: Emerson Electric Co.,, St. Louis, MO (US)

( * ) Notice: Subject to any disclaimer, the term of this patent is extended or adjusted under 35 U.S.C. 154(b) by 0 days.

(21) Appl. No.: 09/235,950

(22) Filed: Jan. 22, 1999

(51) Int. Cl.[7] ..... F04D 29/64

(52) U.S. Cl. ..... 416/244 R; 416/247 R; 415/121.2; 415/213.1

(58) Field of Search ..... 415/213.1, 214.1, 415/220, 121.2; 416/244 R, 247 R, 223 R, 228, 235, 237; 248/317, 318

(56) References Cited

U.S. PATENT DOCUMENTS

| | | | | |
|---|---|---|---|---|
| 4,173,995 | * | 11/1979 | Beck | 415/219 R |
| 4,862,336 | * | 8/1989 | Richardson et al. | 248/317 |
| 5,190,496 | * | 3/1993 | Shih-Chin | 454/210 |
| 5,348,447 | * | 9/1994 | Redetzke | 416/247 R |

* cited by examiner

*Primary Examiner*—Edward K. Look
*Assistant Examiner*—Liam McDowell
(74) *Attorney, Agent, or Firm*—Hovey Williams Timmons & Collins

(57) ABSTRACT

An air circulator fan has front and rear fan guard members, each of which have a grille forming a concave dish. A propeller is positioned between the fan guard members, and is attached to the rotary output of a motor. The motor is positioned centrally on the front fan guard member, in a location downstream from the propeller. When the propeller rotates during operation of the fan, air is drawn through the rear fan guard member and out the front fan guard member. Each grille has a first spacing at a major face portion thereof, and a second, lessor spacing proximate a periphery thereof. This arrangement allows debris (such as feathers in a poultry barn) to pass through the major face portion of each grille, but provides a safety feature near the periphery of the guard members. A three-point mount is provided for suspending the fan, with chains or cables, from an overhead surface. In one embodiment, the three-point mount includes a support brace for providing stability to the fan, both while the fan is placed in a desired location and when the fan is operating.

23 Claims, 5 Drawing Sheets

AIR CIRCULATOR FAN

BACKGROUND OF THE INVENTION

Field of the Invention

The present invention is generally directed to an air circulation type fan. More particularly, the present invention is directed to a unique air circulation type fan having a unique fan guard, a unique motor position, and a unique mounting system, all making the fan especially adapted for utilization in an agricultural setting, such as in a poultry barn.

In agricultural settings, such as in poultry or cattle barns, the air is usually stirred with fans. Particularly, the air flow requirements in such agricultural settings are typically addressed with a box-type fan. A conventional box-type fan has a housing of sheet metal or other solid material forming a periphery about the fan. A venturi is typically mounted within the box of the fan to enhance the air flow generated by the fan. In hot seasons, box type fans are primarily positioned within the walls of a barn, so as to draw air from inside the barn, through the fan, to the exterior of the barn. These wall mounted box fans stir the air within the barn, thus providing a cooling effect.

It is also common for box-type fans to be positioned not only in the walls of a barn, but to have an array of such fans suspended from the ceiling of the barn. The fans serve to stir the air and, particularly, to move a curtain of air from one fan to the next, thus providing a cooling effect within the barn. With box-type fans in both the barn walls and suspended within the barn, the fans provide a stirring ventilation within the barn.

Conventional box-type fans present a number of drawbacks. One primary drawback of box-type fans is that the box structure of the fan actually serves to block air, thus creating dead zones around the fan. Thus, in an environment in which a great number of box-type fans are utilized, as is often the case, the fans actually serve to interrupt air flow, in an undesirable fashion. Additionally, box-type fans utilize a great deal of material, and are thus expensive to manufacture. Box-type fans are also cumbersome to install and difficult to position or reposition as desired.

In contrast to a conventional box-type fan, air circulation fans have been used widely in manufacturing environments, such as automobile fabrication plants, for the purpose of cooling workers. Conventional air circulator fans incorporate a fan guard assembly having front and rear fan guard members detachably connected to each other. Each front and rear fan guard member forms a concave, dish-shaped grill. In such conventional air circulator fans, the rear fan guard member has a central opening for receiving a portion of an electrical motor. The motor is secured by fasteners to the rear fan guard member, and any conventional propeller or blade arrangement is attached to the electrical motor.

While conventional air circulator type fans are very useful in commercial and industrial environments, they are not applicable in agricultural settings, and particularly poultry barns. In this regard, attempting to use a conventional air circulator fan in a poultry barn would cause loose feathers present in the barn to collect on the grille of the guard members, thus clogging the fan. Additionally, in order to achieve the desired air movement in a poultry barn, the type of propeller assembly, and particularly the type of fan blades, used on a conventional box-type fan are much larger and heavier than the type of propeller assembly and blades utilized on a conventional air circulator. Any attempt to replace the blades conventionally used on an air circulator with those conventionally used in a box-type fan would greatly increase the motor requirement for the air circulator, thus making the fan cost prohibitive. Accordingly, although air circulator fans are less expensive to manufacture than a conventional box-type fan, they are wholly inapplicable to meet the needs found in typical agricultural settings, such as poultry barns.

Accordingly, the need exists for an inexpensive fan for utilization in an agricultural setting, such as a poultry barn, which overcomes the drawbacks of the box-type fan. Additionally, the need exists for an air circulator type fan that may be used in an agricultural setting, such as a poultry barn. The present invention overcomes the limitations of the prior art, and meets these and other needs.

SUMMARY OF THE INVENTION

It is an object of the present invention to efficiently stir air in an agricultural setting, such as a poultry barn.

It is an additional object of the present invention to provide an air circulator fan, for use in a poultry barn, which is easy and inexpensive to manufacture.

It is an object of the present invention to reduce or prohibit loose feathers present in a poultry barn from collecting on the fan guard grille of an air circulator fan utilized in a poultry barn.

It is another object of the present invention to provide an air circulator type fan which is easy to install and position within a barn.

It is an additional object of the invention to substantially reduce or eliminate dead zones associated with the case of conventional box-type fans.

These and other objects are achieved by a unique air circulator fan of the present invention. The air circulator fan has front and rear fan guard members. Each front and rear fan guard member has a plurality of spaced apart ribs extending radially outward from a generally central location. A grille, formed from a spiraling rod or concentric rings, is secured over the ribs to form a concave dish-shaped member. The grille is constructed so that the spacing of the grille is greater at a major, face portion of the fan guard member than proximate the outer periphery of the fan guard member. Particularly, in accordance with the principles of the present invention, the spacing of the grille (e.g., the spirally rod or concentric rings) is approximately three times greater at the face of each fan guard member than proximate an outer peripheral edge of each fan guard member. This spacing permits loose feathers and debris to easily pass through the fan guard members without collecting on the grilles, but provides a safety feature at the outer periphery of the fan guard member by having a spacing through which it is difficult for fingers and/or clothing to pass.

A plurality of selected ribs of the ribs of the front fan guard member are each bent at an outer end to form a hook. Each hook overlaps and partially surrounds the outer peripheral rim of the rear fan guard member, thereby securing the two fan guard members together. When the front fan guard member is secured to the rear fan guard member, the radially extending ribs of the respective guard members are offset from each other, to prevent the radially extending ribs of the rear fan guard member from interfering with the hooks. It will be understood that hook members could, alternatively, or additionally, be formed on outer ends of selected ribs of the rear fan guard member.

In accordance with a further aspect of the invention, the front fan guard member has a central opening. The central opening in the front fan guard member receives an output portion of an electrical motor. A propeller assembly, formed of a hub having a number of radially extending wings, and a blade attached to and corresponding to each of the wings, is secured to the output portion of the motor, and is housed within the combined fan guard members. Importantly, the propeller assembly is positioned on the motor so that air is drawn through the rear fan guard member, out the front fan guard member, and across the motor. Stated differently, in accordance with an aspect of the invention, the motor of the air circulator fan is positioned downstream in the high speed region of the air stream produced by the fan. The position of the motor prevents debris from building up on the motor, and also reduces the temperature rise associated with the motor. This motor position also causes the air to turn more axially than if the motor was positioned upstream from the propeller in a conventional manner. This unique arrangement permits a motor of the type used with conventional air circulators to be used in conjunction with fan blades conventionally used on box-type fans, which are designed for axial air flow, a combination that was not previously possible.

In accordance with another aspect of the invention, the air circulator fan provides for a unique mounting arrangement in a suspended position from an overhead surface. In one embodiment, three rings, for receiving the ends of respective chains or cables, are provided on the air circulator fan. One ring is provided on the top of the motor housing, while a pair of rings are provided at spaced applications on one of the fan guard members. The position of the rings permits the fan to be easily positioned and located as desired in a suspended manner. As will be appreciated, by adjusting the length of the various chains, the fan can be positioned so as to throw air in a desired direction. In another embodiment, a brace for suspending the fan from an overhead surface is provided. The support structure includes a pair of metal support beams attached to one of the fan guard members. The support beams extend upwardly from the fan and angle outwardly away from each other at their upper ends. A pair of crossing beams is secured to the upper extending portions of the support beams. In this embodiment, chains or cables are attached proximate an upper end of each support beam and to the motor housing of the motor. Such an arrangement provides stability to the suspended fan, both while positioning the fan in a desired location and during normal operation of the fan.

Additionally, fans in agricultural settings (such as poultry barns) must be able to perform properly even when suspended in a tilted manner. While suspending a conventional box-type fan in a tilted manner often results in undesirable performance, the fan of the present invention performs well even when tilted. In accordance with the present invention, the mounting bracket holds the circulator at an angle so that in the instance of a free hanging fan the thrust action of the air circulator causes the fan assembly to tilt, thereby causing the air flow to be substantially horizontal.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
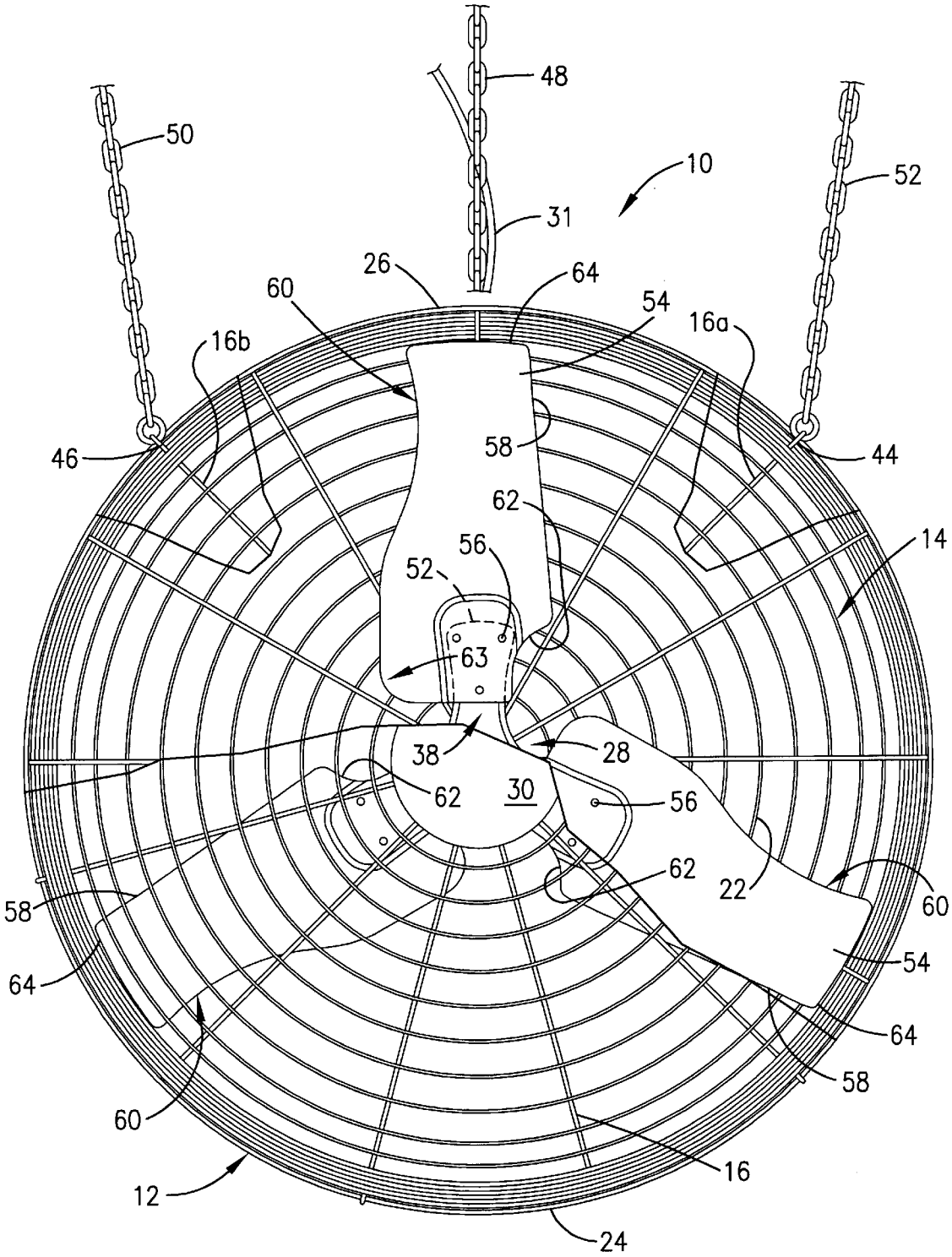
FIG. 1 is a front elevational view of an air circulator fan of the present invention, with portions of the fan removed for ease of illustration and understanding.
Figure 2:
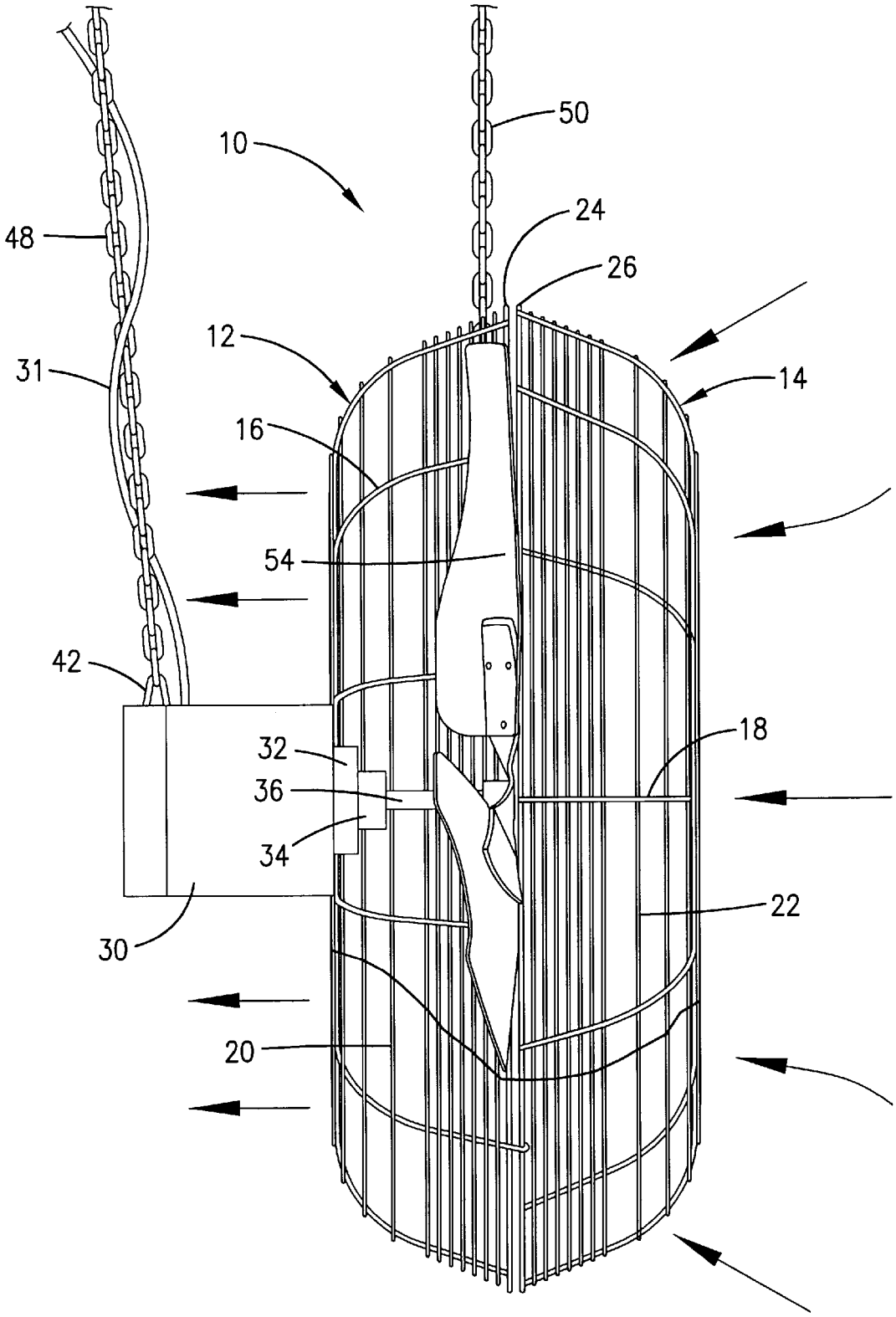
FIG. 2 is a right side elevational view of the air circulator fan of the present invention, with a portion of the fan guard broken away for ease of illustration and understanding.

With reference to FIGS. 1 and 2, an air circulator fan of the present invention is designated generally by reference numeral 10. As shown, air circulator fan 10 has a front fan guard member 12, and a rear fan guard member 14, each of which is preferably formed of metal. Each fan guard member 12, 14 forms a concave dish, and has a plurality of respective ribs 16, 18. The ribs 16, 18 extend radially outward, from a generally central location, to an outer periphery of the respective guard members 12, 14. Each guard member 12, 14 has a grille, or screen, as denoted generally by the reference numerals 20, 22. The grilles 20, 22 are preferably formed by spiraling a wire rod member in the manner illustrated. However, grilles 20, 22 could alternatively be formed from concentric rings. Grilles 20, 22 are secured to respective ribs 12, 14 in any conventional manner, such as by welding. Each guard member 12, 14 has an outer peripheral rim 24, 26 secured to outer portions of associated ribs 12, 14.

In accordance with an aspect of the invention, grilles 20, 22 are formed so to have first and second spacings. Particularly, each grille 20, 22 is spiraled at a major face portion thereof with a spacing that is approximately three times greater than the spacing of the spiral at an outer peripheral portion of the grille. Preferably, the spacing of the spiraling rod (or concentric rings) at the major face portion of each grille 20, 22 is approximately 1½ inches, while the spacing of the spiraling rod (or concentric rings) at the outer peripheral portion of the respective grilles 20, 22 is approximately ½ inch. This unique grille construction permits loose debris, such as feathers, to easily pass through the major face portion of the grilles 20, 22. However, the closely spaced spiral (or rings) at the outer periphery of the grilles 20, 22 provides a safety feature for obstructing fingers and articles of clothing. It will be understood that the fan guard members 12, 14 could be constructed with grilles spaced at other dimensions, or without a reduced spacing at the periphery of the guard member. A fan having grilles with entirely wide spacing will perform better than a fan having more closely space grilles at the periphery of the grilles. Guard members that are more widely spaced about the entirety of the grilles are particularly useful on fans suspended overhead and out of reach.

Each of front guard member 12 and rear guard member 14 defines a central opening. Particularly, rear guard member 14 defines a central opening 28 adapted to receive a cover, or insert, such as a conventional name or logo bearing plate. Front fan guard member 12 has a central aperture (not shown), for receiving an output portion 32, of an electrical motor, having a rotary output 34. Rotary output 34 includes a motor shaft 36 to which a propeller assembly 38, described below, is attached. The electric motor also includes a housing 30, as shown. An electrical chord, for providing power to the motor, is designated by reference numeral 31. Front fan guard member 12 is secured to motor housing 30 by fasteners, in any conventional fastening manner.

In a preferred embodiment of the present invention, air circulator fan 10 employs a propeller 38 having a hub including a number of outwardly extending wings 52. A corresponding blade 54 is attached by fasteners 56 to each wing 52. In operation, propeller 38 rotates in a clockwise direction when viewed from the perspective of FIG. 1. As such, each blade 54 has a leading edge 58 and a trailing edge 60. Each blade 54 has an arcuate cut-away portion 62 at a base of the leading edge 58 of the blade 54, and a flared portion 63 at an inner, trailing portion of the blade 54. As illustrated, the distance between the leading edge 58 and trailing edge 60 of each blade is greater proximate the hub 50 than proximate an outer tip 64 of the blade 54. Preferably, each blade 54 is of a type that is manufactured by Revcor, under Specification No. 5-2767. With such blades, the centerline at the inlet region of the fan 10 is not void of a velocity profile. Such blades are particularly useful for stirring air and cooling the fan motor.

The preferred embodiment of the present invention is a thirty-six (36) inch air circulator fan. In this regard, it is preferred that the diameter of an imaginary circle is formed by the outer tips 64 of propeller 38 when it rotates is slightly less than thirty-six inches and, preferably, is greater than thirty-five inches. More particularly, it is preferred that the stated diameter is 35.8 inches. Preferably, the electrical motor is a 0.5 horsepower motor, although a larger motor could be utilized. For example, a one (1) horsepower motor is preferred for a larger fan, such as a fan having a diameter of approximately forty-eight (48) inches.

Air circulator fan 10 also has a unique mount for suspending the fan 10 from an overhead surface. In one embodiment, motor housing 30 includes a ring 42 on its upper surface. Additionally, a selected pair of outwardly extending ribs 16 on front fan guard member 12, designated herein as ribs 16*a*, 16*b*, include rings 44, 46 as illustrated. Rings 42, 44 and 46 are positioned to receive respective chains or cables 48, 50 and 51. As will be appreciated, the position of rings 42, 44, and 46 permit the air circulator fan 10 of the present invention to be suspended from an overhead surface, such as a ceiling in a barn. By adjusting the cables or chains 48, 50, 51, the air circulator fan 10 can be positioned as desired. The unique placement of rings 42, 44 and 46 permit air circulator fan 10 to be easily installed and positioned in a desired location and manner. It will be understood and appreciated that rings could additionally or alternatively be provided on rear fan guard member 14, or a combination of guard members 12, 14, and utilized for suspending air circulator fan 10 in a hanging manner.

Figure 3:
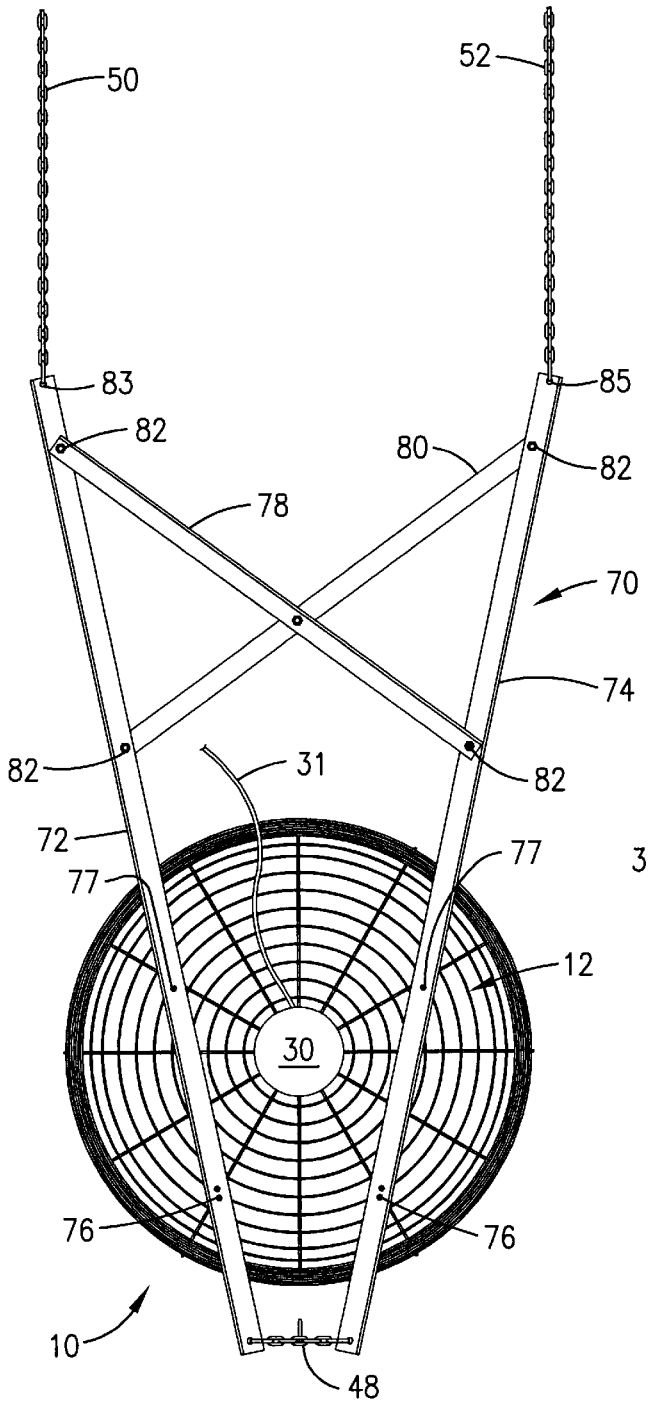
FIG. 3 is a front elevational view of an air circulator fan of the present invention, illustrating a support brace for suspending the fan.
Figure 4:
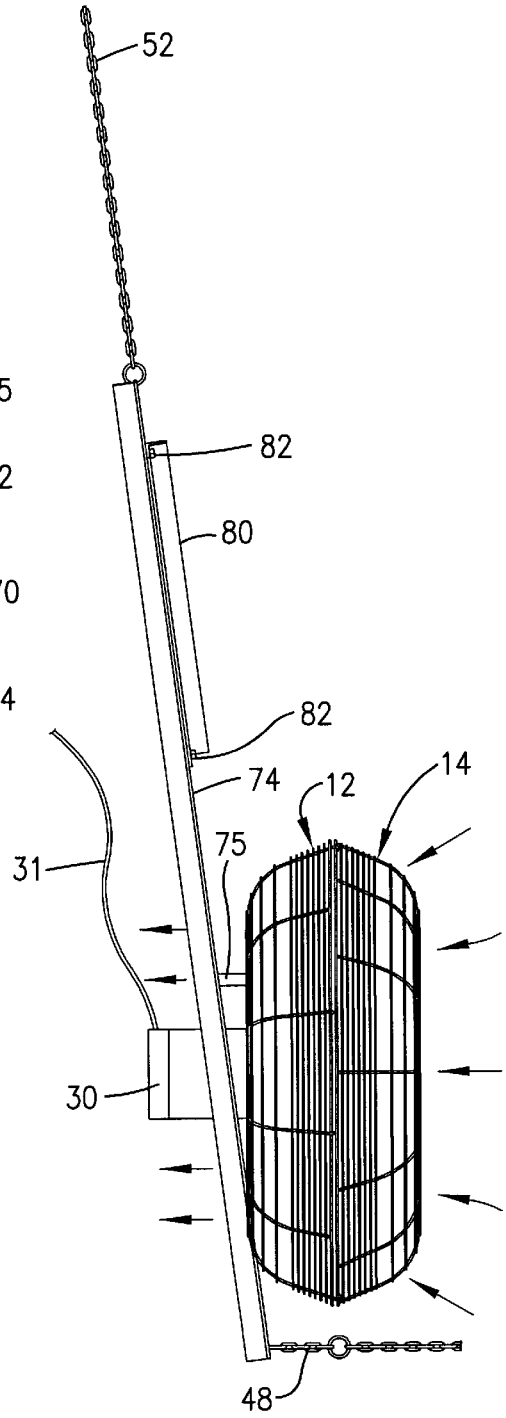
FIG. 4 is a right side elevational view of the illustration of FIG. 3.

In another embodiment, as illustrated in FIGS. 3 and 4, a brace, designated generally by reference numeral 70, is provided. Brace 70 has first and second support beams 72, 74 fastened, by fasteners 76, to front fan guard member 12. Additionally, support beams 72, 74 are secured to guard member 12 by a pair of spacer support members 75 and is fastened to a respective beam 72, 74 by a fastener 76. Support beams 72, 74, as illustrated, are constructed of angle-iron, but could be constructed in other manners. Furthermore, fasteners 76 are preferably U-bolts, but it will be understood that brace 70 could be attached to front fan guard member 12 according to any conventional attachment technique. Spacers 75 are preferably constructed of a J-hook which is hooked about the grille of guard 12. Additionally, although brace 70 is preferably attached to front fan guard member 12 (e.g., on the motor side of fan 10), it should be understood that brace 70 could alternatively be fastened to rear fan guard member 14 or to both front and rear guard members 12, 14 if brace 70 were slightly modified. As illustrated, each support beam 72, 74 angles outwardly from a center line of fan 10, such that the distance between the uppermost ends of support beams 72, 74 is preferably greater than the diameter of fan 10.

A pair of cross beams 78, 80 are fastened, by fasteners 82, to the upwardly extending portion of support beams 72, 74, as illustrated, to provide structural stability to brace 70. Chain (or cable, rope, etc.) 50 is attached proximate an upper end of support beam 72 and chain 51 is attached proximate an upper end of support beam 74, at respective apertures 83, 85. Chain 48 is preferably linked to the lowermost ends of beams 72, 74, as illustrated, and has a portion connected to the link and extending rearwardly, as illustrated in FIG. 4. Alternatively, chain 48 could be attached to a ring on motor housing 30, as previously described. Chains 48, 50 and 51 are suspended from an overhead surface (not shown). As in the foregoing embodiment, by adjusting chains 48, 50, and 51, air circulator fan 10 can be adjusted as desired. Brace 70 provides stability to fan 10, both while fan 10 is moved into (or out of) a desired position, and also while suspended in a desired location and position for normal operation of fan 10.

In use, air circulator fan 10 is installed in a desired location within an agricultural facility, such as a poultry barn. Particularly, air circulator fan 10 is suspended from an overhead support, such as a ceiling, by chains or cables 48, 50 and 51. As previously described, the outer ends of the respective chains or cables are connected to respective rings 42, 44, and 46, or to the brace 70, as described. By adjusting the length of one or more of the chains or cables 48, 50, 51, the precise position of air circulator fan 10 can be selected. This is a great improvement over the prior art type box fans which were difficult to selectively mount and which made it difficult to control air direction.

Figure 5:
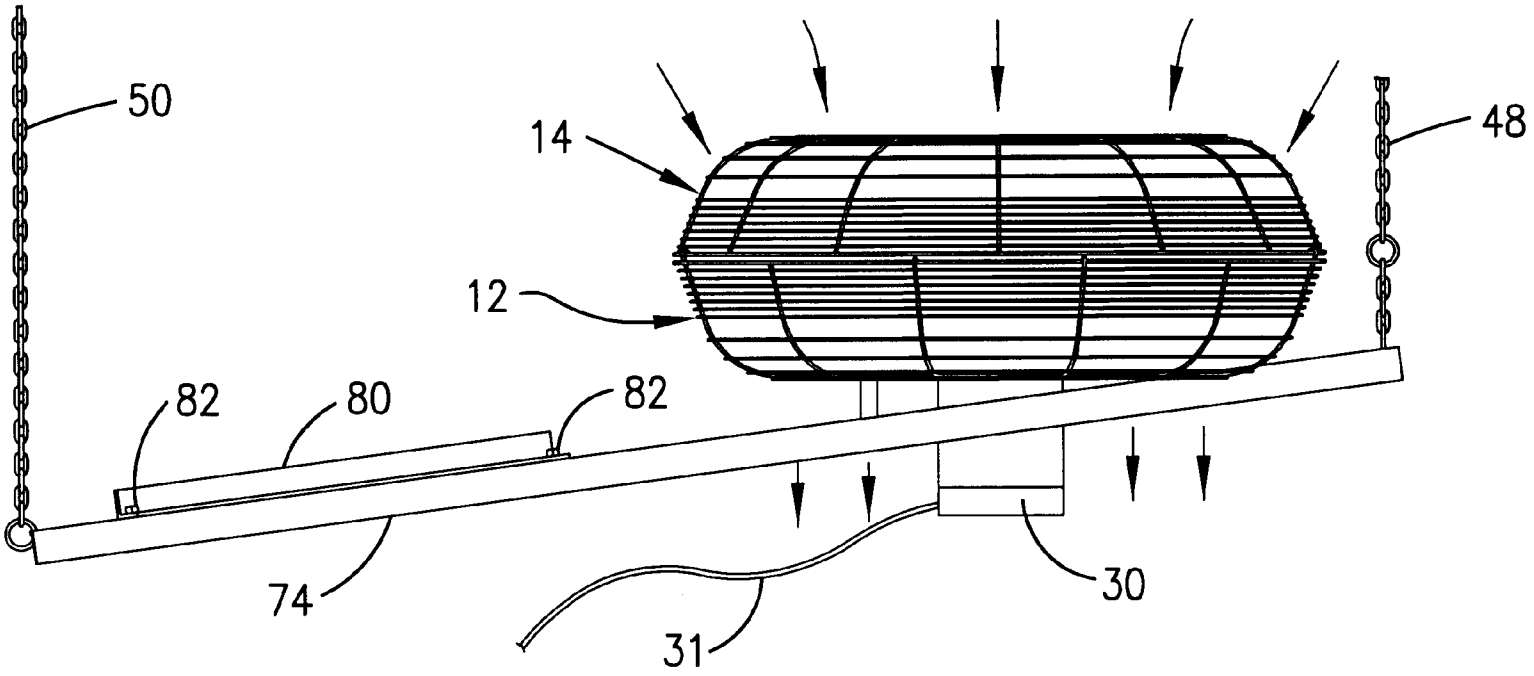
FIG. 5 is a side elevational view of an alternate orientation for suspending the fan.
Figure 6:
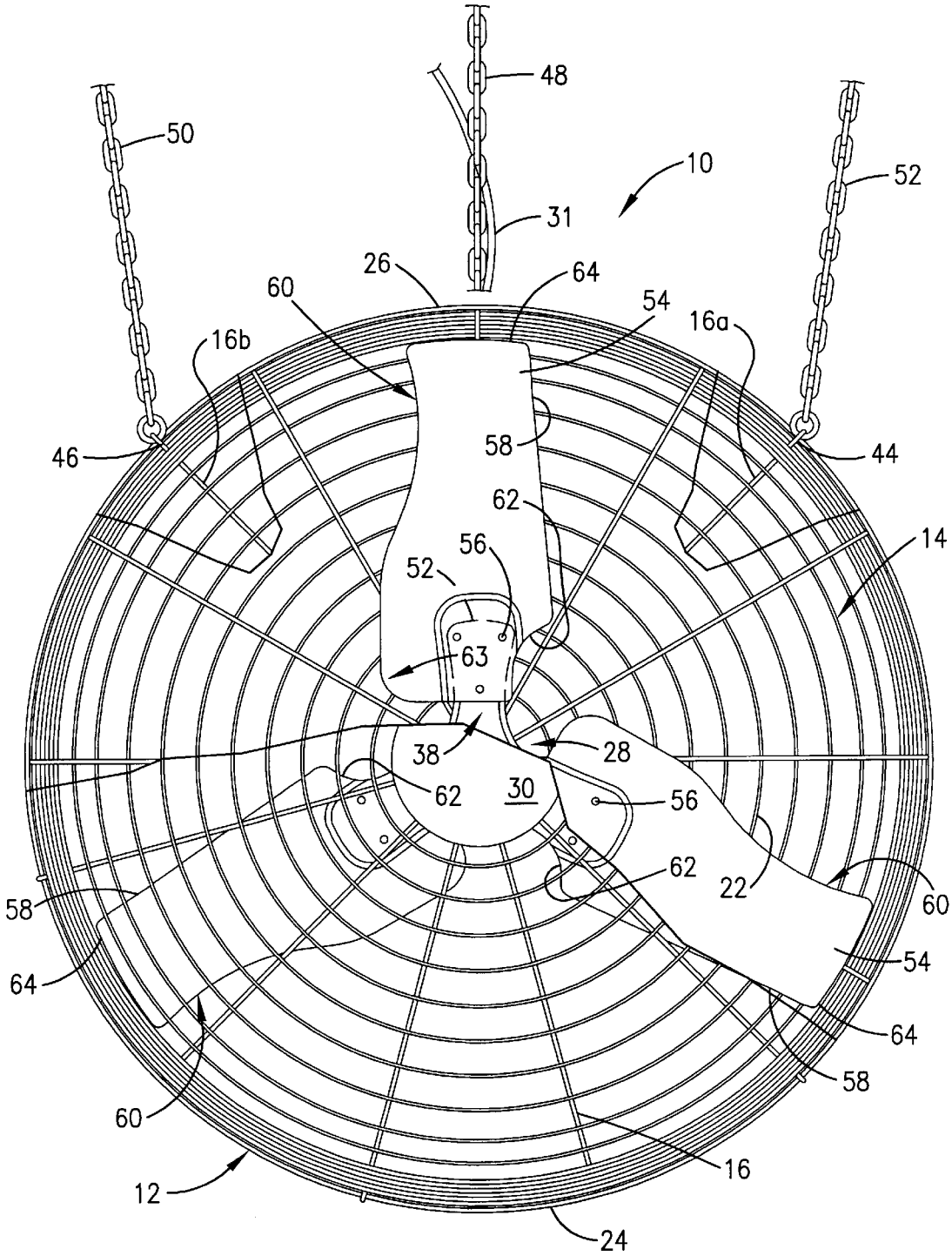
FIG. 6 is a front elevational view of an air circulator fan of the present invention illustrating a spirally formed grill on a fan cage, according to the present invention.

In operation, electrical motor of air circulator fan 10 is activated, causing propeller 38 to rotate in a clockwise direction when viewed from the view of FIG. 1. Rotation of propeller 38 in such a manner draws air in the direction of the arrows in FIG. 2, FIG. 4, and FIG. 5 (which illustrates a fan 10 mounted for vertical distribution of air) and particularly air is drawn through rear fan guard 14, and blown past front fan guard 12, and across motor housing 30. The unique spacing of the grilles 20, 22 permits debris, such as feathers, within the poultry barn to easily pass through the major face portions of the grilles. Additionally, the unique positioning of the electrical motor prevents feathers and other debris from building up on the motor, and also reduces the heat rise that would otherwise be present if the motor were positioned upstream in the air flow, from the propeller, as in conventional air circulator fans.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A fan comprising:

a front fan guard member having a grille forming a concave dish;

a rear fan guard member having a grille forming a concave dish;

a motor connected to said front fan guard member, said motor having a rotary output with an outer end extending between said front and rear fan guard members;

a propeller attached to said outer end of said rotary output of said motor, wherein said propeller, when rotating, draws air in a direction through said rear fan guard member and out said front fan guard member.

2. The fan as set forth in claim 1, wherein said motor is attached at a central location on said front fan guard member.

3. The fan as set forth in claim 1, wherein each said grille has a first spacing at a major face portion thereof and a second spacing proximate an outer periphery thereof, wherein said first spacing is greater than said second spacing.

4. The fan as set forth in claim 3, wherein said first spacing is three times greater than said second spacing.

5. The fan as set forth in claim 1, wherein said propeller has a central hub having a plurality of blades, each said blade having a leading edge and a trailing edge, wherein said leading edge forms a cut-away notch in said blade proximate said central hub.

6. The fan as set forth in claim 5, wherein each said blade is flared at a trailing edge proximate said central hub.

7. The fan as set forth in claim 1, said fan further comprising a three-point mount for suspending said fan from an overhead surface.

8. The fan as set forth in claim 7, said motor having a housing, said three-point mount comprising:

a first attachment location on said motor housing;

second and third spaced-apart attachment locations on one of said front and said rear fan guard members.

9. The fan as set forth in claim 8, wherein said second and third spaced-apart attachment locations are on said front fan guard member.

10. The fan as set forth in claim 7, said motor having a housing, said three-point mount comprising:

a brace, attached to at least one of said front and rear fan guard members, said brace having first and second support beams extending upwardly from said fan, each said support beam having an attachment location proximate an upper end thereof, and proximate a lower end thereof.

11. The fan as set forth in claim 10, further comprising at least one spacer positioned between said brace and the said one of said front and rear fan guard members to which said brace is attached.

12. A fan guard comprising:

a front fan guard member having a grille forming a concave dish;

a rear fan guard member having a grille forming a concave dish, wherein at least one of said grilles has a first spacing at a major face portion thereof and a second spacing proximate an outer periphery thereof, wherein said first spacing is greater than said second spacing; and wherein each said fan guard member has a plurality of ribs extending radially outward, and each said grille is formed of a spiraling rod attached to the ribs of its respective guard member.

13. The fan guard as set forth in claim 12, wherein said first grille spacing is approximately three times greater than said second grille spacing.

14. The fan guard as set forth in claim 12, wherein said first grille spacing is approximately one and one-half inches and said second grille spacing is approximately one-half inch.

15. The fan guard as set forth in claim 12, in combination with fan components, said combination comprising:

a motor having a rotary output with an outer end terminating between said front and rear fan guard members;

a propeller attached to said outer end of said rotary output of said motor.

16. A fan comprising:

a first fan guard member having a grille forming a concave dish;

a second fan guard member having a grille forming a concave dish;

a motor having a rotary output with an outer end terminating between said first and second fan guard members, said motor having a motor housing;

a propeller attached to said outer end of said rotary output of said motor; and a multi-point mount having at least three mounting locations, wherein a first mounting location is positioned on said motor housing, and a second and a third mounting location are positioned at spaced-apart locations on one of said front and rear fan guard members.

17. The fan as set forth in claim 16, wherein said mounting locations comprise rings for permitting the fan to be suspended from an overhead surface.

18. The fan as set forth in claim 16, wherein said motor is attached to said front fan guard member, and wherein said propeller, when rotating, draws air through said rear fan guard member and out said front fan guard member.

19. The fan as set forth in claim 18, wherein said first and second mounting locations are positioned on said front fan guard member.

20. A fan comprising:

a front fan guard member;

a rear fan guard member connected to the front fan guard member;

a motor connected to the front fan guard member, the motor having a unidirectional rotary output with an outer end extending between the front and rear fan guard members; and a propeller attached to the outer end of the rotary output of the motor, wherein said propeller, when rotating, draws air in a direction through the rear fan guard member and out the front fan guard member.

21. The fan as set forth in claim 20, wherein the front and rear fan guards cooperate to define an area where the propeller rotates and wherein the motor is located outside the area.

22. The fan as set forth in claim 20, wherein the front fan guard member has an inwardly/propeller facing side and an outwardly facing side and wherein the motor is connected to the front fan guard member on the outwardly facing side.

23. A fan comprising:

a front fan guard member;

a rear fan guard member connected to the front fan guard member;

a motor connected to the front fan guard member, the motor having a rotary output with an outer end extending between the front and rear fan guard members; and a propeller attached to the outer end of the rotary output of the motor, the propeller having a plurality of blades, the blades having a concave surface, wherein the blades are oriented such that the concave surfaces of the blades face the motor and wherein said propeller, when rotating, draws air in a direction through the rear fan guard member and out the front fan guard member.

* * * * *